US010708679B2

(12) United States Patent
Leppanen et al.

(10) Patent No.: US 10,708,679 B2
(45) Date of Patent: Jul. 7, 2020

(54) DISTRIBUTED AUDIO CAPTURE AND MIXING

(71) Applicant: Nokia Technologies Oy, Espoo (FI)

(72) Inventors: Jussi Leppanen, Tampere (FI); Arto Lehtiniemi, Lempaala (FI); Antti Eronen, Tampere (FI); Francesco Cricri, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/464,743

(22) PCT Filed: Nov. 20, 2017

(86) PCT No.: PCT/FI2017/050792
§ 371 (c)(1),
(2) Date: May 29, 2019

(87) PCT Pub. No.: WO2018/100232
PCT Pub. Date: Jun. 7, 2018

(65) Prior Publication Data

US 2019/0313174 A1 Oct. 10, 2019

(30) Foreign Application Priority Data

Nov. 30, 2016 (GB) ..... 1620325.9

(51) Int. Cl.
*H04R 1/08* (2006.01)
*H04R 1/32* (2006.01)
(Continued)

(52) U.S. Cl.
CPC ..... *H04R 1/08* (2013.01); *H04R 1/326* (2013.01); *H04R 5/027* (2013.01); *H04R 5/04* (2013.01);
(Continued)

(58) Field of Classification Search
CPC . H04R 1/08; H04R 5/04; H04R 1/326; H04R 27/00; H04S 7/302; H04S 7/40;
(Continued)

(56) References Cited

U.S. PATENT DOCUMENTS

2012/0295637 A1 11/2012 Hannuksela ..... 455/456.1
2015/0156578 A1* 6/2015 Alexandridis ..... H04R 3/005 381/92
(Continued)

FOREIGN PATENT DOCUMENTS

WO WO 2016/097477 A1 6/2016

*Primary Examiner* — Yogeshkumar Patel
(74) *Attorney, Agent, or Firm* — Harrington & Smith

(57) ABSTRACT

An apparatus for controlling a controllable position/orientation of at least one audio source within an audio scene, the audio scene including the at least one audio source; a capture device, the apparatus including a processor configured to: receive a physical position/orientation of the at least one audio source relative to a capture device capture orientation; receive an earlier physical position/orientation of the at least one audio source relative to the capture device capture orientation; receive at least one control parameter; and control a controllable position/orientation of the at least one audio source, the controllable position being between the physical position/orientation of the at least one audio source relative to the capture device capture orientation and the earlier physical position/orientation of the at least one audio source relative to the capture device capture orientation and based on the control parameter.

21 Claims, 11 Drawing Sheets

(51) Int. Cl.

| | |
|---|---|
| ***H04R 5/027*** | (2006.01) |
| ***H04R 5/04*** | (2006.01) |
| ***H04S 7/00*** | (2006.01) |
| ***H04R 27/00*** | (2006.01) |

(52) U.S. Cl.
CPC ..... *H04S 7/302* (2013.01); *H04R 27/00* (2013.01); *H04S 2400/01* (2013.01); *H04S 2400/11* (2013.01); *H04S 2400/15* (2013.01)

(58) Field of Classification Search
CPC ..... H04S 2400/11; H04S 2400/01; H04S 2400/15
See application file for complete search history.

(56) References Cited

U.S. PATENT DOCUMENTS

| | | | | |
|---|---|---|---|---|
| 2015/0319530 | A1* | 11/2015 | Virolainen ..... | G10L 19/008 381/303 |
| 2016/0080886 | A1 | 3/2016 | De Bruijn et al. | |
| 2016/0183024 | A1* | 6/2016 | Karkkainen ..... | H04S 7/303 381/17 |

* cited by examiner $$\tilde{\alpha}_i = \alpha_i - w(\alpha_i - \hat{\alpha}_i)$$

$$\tilde{x}_i = (1-q)*x_i + q*\hat{x}_i$$

$$\tilde{y}_i = (1-q)*y_i + q*\hat{y}_i$$

DISTRIBUTED AUDIO CAPTURE AND MIXING

CROSS REFERENCE TO RELATED APPLICATION

This patent application is a U.S. National Stage application of International Patent Application Number PCT/FI2017/050792 filed Nov. 20, 2017, which is hereby incorporated by reference in its entirety, and claims priority to GB 1620325.9 filed Nov. 30, 2016.

FIELD

The present application relates to apparatus and methods for distributed audio capture and mixing. The invention further relates to, but is not limited to, apparatus and methods for distributed audio capture and mixing for spatial processing of audio signals to enable spatial reproduction of audio signals.

BACKGROUND

Capture of audio signals from multiple sources and mixing of audio signals when these sources are moving in the spatial field requires significant effort. For example the capture and mixing of an audio signal source such as a speaker or artist within an audio environment such as a theatre or lecture hall to be presented to a listener and produce an effective audio atmosphere requires significant investment in equipment and training.

A commonly implemented system is where one or more close microphones, for example a Lavalier microphone worn by the user or an audio channel associated with an instrument is mixed with a suitable spatial (or environmental or audio field) audio signal such that the produced sound comes from an intended direction.

However as will be shown hereafter the positioning of the close microphone and other audio sources relative to the capture device may produce a poor quality output where the audio sources are not significantly distributed.

Thus, there is a need to develop solutions which enhance the spatial audio mixing and sound track creation process.

SUMMARY

There is provided according to a first aspect an apparatus for controlling a controllable position/orientation of at least one audio source within an audio scene, the audio scene comprising: the at least one audio source; a capture device comprising a microphone array for capturing audio signals of the audio scene, the capture device having a capture orientation wherein the microphone array is positioned relative to the capture orientation, the apparatus comprising a processor configured to: receive a physical position/orientation of the at least one audio source relative to the capture device capture orientation; receive an earlier physical position/orientation of the at least one audio source relative to the capture device capture orientation; receive at least one control parameter; and control a controllable position/orientation of the at least one audio source, the controllable position being between the physical position/orientation of the at least one audio source relative to the capture device capture orientation and the earlier physical position/orientation of the at least one audio source relative to the capture device capture orientation and based on the control parameter.

The capture device may further comprise at least one camera for capturing images of the audio scene, wherein the at least one camera may be positioned relative to the capture orientation.

During a capture session the controllable position/orientation for the at least one audio source may be defined for one of the at least one audio source between the earlier physical position/orientation which may be captured on a first image of the at least one camera and the physical position/orientation which may be captured on a second image of the at least one camera.

The processor configured to control the controllable position/orientation of the at least one audio source may be configured to control the controllable position/orientation of the at least one audio source relative to the capture device capture orientation such that the controllable position/orientation may be the earlier physical position/orientation of the at least one audio source relative to the capture device capture orientation, such that a visually observed position/orientation of the at least one audio source differs from an audio experienced position/orientation of the at least one audio source.

The processor may be configured to pass the controllable position/orientation of the at least one audio source to a renderer to control a mixing or rendering of an audio signal associated with the at least one audio source based on the controllable position/orientation.

The processor configured to receive at least one control parameter may be configured to receive a weighting parameter, and the processor configured to control the controllable position/orientation may be further configured to: determine the controllable orientation based on one of the physical orientation of the at least one audio source relative to the capture device capture orientation and the earlier physical orientation of the at least one audio source relative to the capture device capture orientation which is combined with the product of the weighting parameter applied to an orientation difference between the the physical orientation of the at least one audio source relative to the capture device capture orientation and the earlier physical position/orientation of the at least one audio source relative to the capture device capture orientation; and determine the controllable position as the intersection between a line described by the physical position of the at least one audio source relative to the capture device capture orientation and the earlier physical position of the at least one audio source relative to the capture device reference orientation and a line from the capture device at the controllable orientation.

The processor configured to receive at least one control parameter may be configured to receive a weighting parameter, and the processor configured to control the controllable position/orientation may be further configured to: determine the controllable orientation based on one of the physical orientation of the at least one audio source relative to the capture device capture orientation and the earlier physical orientation of the at least one audio source relative to the capture device capture orientation combined with the product of the weighting parameter applied to an orientation difference between the physical orientation of the at least one audio source relative to the capture device capture orientation and the earlier physical position/orientation of the at least one audio source relative to the capture device capture orientation, and determine the controllable position based on an arc with an origin at the capture device and defined by the physical position of the at least one audio source relative to the capture device capture orientation and the earlier physical position of the at least one audio source relative to the capture device capture orientation to the capture device capture orientation and a line from the capture device at the controllable orientation.

The processor configured to receive the at least one control parameter may be configured to receive a weighting parameter, and wherein the processor configured to control the controllable position/orientation may be further configured to combine the product of unity minus the weighting parameter to the physical position of the at least one audio source relative to the capture device capture orientation and the product of the weighting function to the earlier physical position of the at least one audio source relative to the capture device capture orientation.

The processor configured to control the controllable position/orientation of the at least one audio source may be further configured to control a width of the controllable position/orientation, the width of the controllable position/orientation may be based on the distance from the physical position/orientation of at least one audio source relative to the capture device capture orientation.

The processor configured to control the width of the controllable position/orientation may be configured to set the width of the controllable position/orientation as one half a normalised distance from the physical position/orientation of the at least one audio source relative to the capture device capture orientation.

According to a second aspect there is provided a method for controlling a controllable position/orientation of at least one audio source within an audio scene, the audio scene comprising: the at least one audio source; a capture device comprising a microphone array for capturing audio signals of the audio scene, the capture device having a capture orientation wherein the microphone array is positioned relative to the capture orientation, the method comprising: receiving a physical position/orientation of the at least one audio source relative to the capture device capture orientation; receiving an earlier physical position/orientation of the at least one audio source relative to the capture device capture orientation; receiving at least one control parameter; and controlling a controllable position/orientation of the at least one audio source, the controllable position being between the physical position/orientation of the at least one audio source relative to the capture device capture orientation and the earlier physical position/orientation of the at least one audio source relative to the capture device capture orientation and based on the control parameter.

The capture device may further comprise at least one camera for capturing images of the audio scene, wherein the at least one camera may be positioned relative to the capture orientation.

During a capture session the controllable position/orientation for the at least one audio source may be defined for one of the at least one audio source between the earlier physical position/orientation which may be captured on a first image of the at least one camera and the physical position/orientation which may be captured on a second image of the at least one camera.

Controlling the controllable position/orientation of the at least one audio source may comprise controlling the controllable position/orientation of the at least one audio source relative to the capture device capture orientation such that the controllable position/orientation is the earlier physical position/orientation of the at least one audio source relative to the capture device capture orientation, such that a visually observed position/orientation of the at least one audio source differs from an audio experienced position/orientation of the at least one audio source.

The method may further comprise passing the controllable position/orientation of the at least one audio source to a renderer to control a mixing or rendering of an audio signal associated with the at least one audio source based on the controllable position/orientation.

Receiving at least one control parameter may comprise receiving a weighting parameter, and controlling the controllable position/orientation may further comprise: determining the controllable orientation based on one of the physical orientation of the at least one audio source relative to the capture device capture orientation and the earlier physical orientation of the at least one audio source relative to the capture device capture orientation which is combined with the product of the weighting parameter applied to an orientation difference between the the physical orientation of the at least one audio source relative to the capture device capture orientation and the earlier physical position/orientation of the at least one audio source relative to the capture device capture orientation, and determining the controllable position as the intersection between a line described by the physical position of the at least one audio source relative to the capture device capture orientation and the earlier physical position of the at least one audio source relative to the capture device reference orientation and a line from the capture device at the controllable orientation.

Receiving at least one control parameter may comprise receiving a weighting parameter, and controlling the controllable position/orientation may further comprise: determining the controllable orientation based on one of the physical orientation of the at least one audio source relative to the capture device capture orientation and the earlier physical orientation of the at least one audio source relative to the capture device capture orientation combined with the product of the weighting parameter applied to an orientation difference between the the physical orientation of the at least one audio source relative to the capture device capture orientation and the earlier physical position/orientation of the at least one audio source relative to the capture device capture orientation, and determining the controllable position based on an arc with an origin at the capture device and defined by the physical position of the at least one audio source relative to the capture device capture orientation and the earlier physical position of the at least one audio source relative to the capture device capture orientation to the capture device capture orientation and a line from the capture device at the controllable orientation.

Receiving the at least one control parameter may comprise receiving a weighting parameter, and wherein controlling the controllable position/orientation may further comprise combining the product of unity minus the weighting parameter to the physical position of the at least one audio source relative to the capture device capture orientation and the product of the weighting function to the earlier physical position of the at least one audio source relative to the capture device capture orientation.

Controlling the controllable position/orientation of the at least one audio source may further comprise controlling a width of the controllable position/orientation, the width of the controllable position/orientation being based on the distance from the physical position/orientation of at least one audio source relative to the capture device capture orientation.

Controlling the width of the controllable position/orientation may comprise setting the width of the controllable position/orientation as one half the normalised distance from the physical position/orientation of the at least one audio source relative to the capture device capture orientation.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
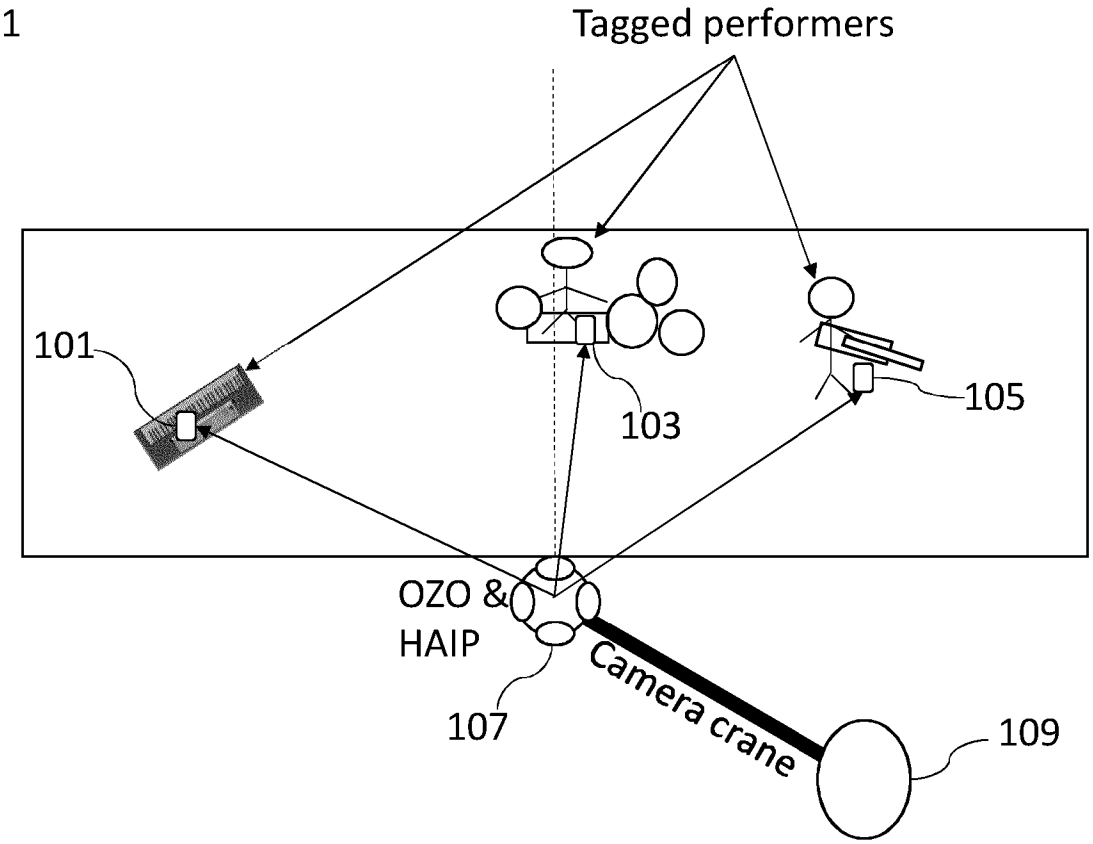
FIG. 1 shows schematically an example capture and mixing arrangement where the close microphones and the microphone array are in a first position arrangement producing a wide separation of sound sources.

The following describes in further detail suitable apparatus and possible mechanisms for the provision of effective capture of audio signals from multiple sources and mixing of those audio signals when these sources are moving in the spatial field. In the following examples, audio signals and audio capture signals are described. However it would be appreciated that in some embodiments the apparatus may be part of any suitable electronic device or apparatus configured to capture an audio signal or receive the audio signals and other information signals.

A conventional approach to the capturing and mixing of audio sources with respect to an audio background or environment audio field signal would be for a professional producer to utilize a close microphone (a Lavalier microphone worn by the user, or a microphone attached to an instrument or some other microphone) to capture audio signals close to the audio source, and further utilize a 'background' microphone to capture a environmental audio signal. These signals or audio tracks may then be manually mixed to produce an output audio signal such that the produced sound features the audio source coming from an intended (though not necessarily the original) direction.

The concept as described herein may be considered to be enhancement to conventional Spatial Audio Capture (SPAC) technology. Spatial audio capture technology can process audio signals captured via a microphone array into a spatial audio format. In other words generating an audio signal format with a spatial perception capacity. The concept may thus be embodied in a form where audio signals may be captured such that, when rendered to a user, the user can experience the sound field as if they were present at the location of the capture device. Spatial audio capture can be implemented for microphone arrays found in mobile devices. In addition, audio processing derived from the spatial audio capture may be used employed within a presence-capturing device such as the Nokia OZO (OZO) devices.

In the examples described herein the audio signal is rendered into a suitable binaural form, where the spatial sensation may be created using rendering such as by head-related-transfer-function (HRTF) filtering a suitable audio signal.

The concept as described with respect to the embodiments herein makes it possible to capture and remix a close and environment audio signal more effectively and produce a better quality output where the sound or audio sources are more widely distributed.

The concept may for example be embodied as a capture system configured to capture both a close (speaker, instrument or other source) audio signal and a microphone array or spatial (audio field) audio signal. The capture system may furthermore be configured to determine a location of the close audio signal source relative to the spatial capture components and further determine the audio signal delay required to synchronize the close audio signal to the spatial audio signal. This information may then be stored or passed to a suitable rendering system which having received audio signals associated with the microphones and microphone array and the spatial metadata such as positional information may use this information to generate a suitable mixing and rendering of the audio signal to a user.

Furthermore in some embodiments the render system enables the user to input a suitable input to control the mixing, for example control the positioning of the close microphone mixing positions.

The concept furthermore is embodied by the ability to track locations of the close microphones generating the close audio signals using high-accuracy indoor positioning or another suitable technique. The position or location data (azimuth, elevation, distance) can then be associated with the spatial audio signal captured by the microphones. The close audio signals captured by the close microphones may in some embodiments be furthermore processed, for example time-aligned with the microphone array audio signal, and made available for rendering. For reproduction with static loudspeaker setups such as 5.1, a static downmix can be done using amplitude panning techniques. For reproduction using binaural techniques, the time-aligned close microphone audio signals can be stored or communicated together with time-varying spatial position data and the microphone array audio signals or audio track. For example, the audio signals could be encoded, stored, and transmitted in a Moving Picture Experts Group (MPEG) MPEG-H 3D audio format, specified as ISO/IEC 23008-3 (MPEG-H Part 3), where ISO stands for International Organization for Standardization and IEC stands for International Electrotechnical Commission.

It is believed that the main benefits of the invention include flexible capturing of spatial audio and separation of close microphone audio signals, which enables an enhanced rendering of the audio signals for the user or listener. An example includes increasing speech intelligibility in noisy capture situations, in reverberant environments, or in capture situations with multiple direct and ambient sources.

Although capture and render systems may be separate, it is understood that they may be implemented with the same apparatus or may be distributed over a series of physically separate but communication capable apparatus. For example, a presence-capturing device such as the OZO device could be equipped with an additional interface for receiving location data and close microphone audio signals, and could be configured to perform the capture part. The output of a capture part of the system may be the microphone audio signals (e.g. as a 5.1 channel downmix), the close microphone audio signals (which may furthermore be time-delay compensated to match the time of the microphone array audio signals), and the position information of the close microphones (such as a time-varying azimuth, elevation, distance with regard to the microphone array).

In some embodiments the raw microphone array audio signals captured by the microphone array may be transmitted to the renderer (instead of spatial audio processed into 5.1), and the renderer performs spatial processing such as described herein.

The renderer as described herein may be an audio playback device (for example a set of headphones), user input (for example motion tracker), and software capable of mixing and audio rendering. In some embodiments the user input and audio rendering parts may be implemented within a computing device with display capacity such as a mobile phone, tablet computer, virtual reality headset, augmented reality headset etc.

Furthermore it is understood that at least some elements of the following mixing and rendering may be implemented within a distributed computing system such as known as the 'cloud'.

With respect to FIG. 1 is shown a first example capture and mixing arrangement where the close microphones and the microphone array are in a first position arrangement producing a wide separation of sound sources. In this and the following examples a band performance is being recorded. However this is an example implementation only and it is understood that the apparatus may be used in any suitable recording scenario.

FIG. 1 shows the performers' 101, 103, 105 (and/or the instruments that are being played) positions being tracked (by using position tags) and equipped with microphones. For example the capture apparatus 101 comprises a Lavalier microphone 111. The close microphones may be any microphone external or separate to microphone array configured to capture the spatial audio signal. Thus the concept is applicable to any external/additional microphones be they Lavalier microphones, hand held microphones, mounted mics, or whatever. The external microphones can be worn/carried by persons or mounted as close-up microphones for instruments or a microphone in some relevant location which the designer wishes to capture accurately. The close microphone may in some embodiments be a microphone array. A Lavalier microphone typically comprises a small microphone worn around the ear or otherwise close to the mouth. For other sound sources, such as musical instruments, the audio signal may be provided either by a Lavalier microphone or by an internal microphone system of the instrument (e.g., pick-up microphones in the case of an electric guitar) or an internal audio output (e.g., a electric keyboard output). In some embodiments the close microphone may be configured to output the captured audio signals to a mixer. The close microphone may be connected to a transmitter unit (not shown), which wirelessly transmits the audio signal to a receiver unit (not shown).

Furthermore in some embodiments the close microphone comprises or is associated with a microphone position tag. The microphone position tag may be configured to transmit a radio signal such that an associated receiver may determine information identifying the position or location of the close microphone. It is important to note that microphones worn by people can be freely moved in the acoustic space and the system supporting location sensing of wearable microphone has to support continuous sensing of user or microphone location. The close microphone position tag may be configured to output this signal to a position tracker. Although the following examples show the use of the HAIP (high accuracy indoor positioning) radio frequency signal to determine the location of the close microphones it is understood that any suitable position estimation system may be used (for example satellite-based position estimation systems, inertial position estimation, beacon based position estimation etc.).

Furthermore the system is shown comprising a microphone array (shown by the Nokia OZO device) 107. In some embodiments the microphone array may comprise a position estimation system such as a high accuracy in-door position (HAIP) receiver configured to determine the position of the close microphones relative to the 'reference position and orientation' of the microphone array. In some embodiments the estimation of the position of the close microphones relative to the microphone array is performed within a device separate from the microphone array. In such embodiments the microphone array may itself comprise a position tag or similar to enable the further device to estimate and/or determine the position of the microphone array and the close microphones and thus determine the relative position and orientation of the close microphones to the microphone array. The microphone array may be configured to output the tracked position information to a mixer (not shown in FIG. 1).

The microphone array 107 is an example of a spatial audio capture (SPAC) device or an 'audio field' capture apparatus and may in some embodiments be a directional or omnidirectional microphone array. The microphone array may be configured to output the captured audio signals or a processed form (for example a 5.1 downmix of the audio signals) to a mixer (not shown in FIG. 1).

In some embodiments the microphone array is implemented within a mobile device.

The microphone array is thus configured to capture spatial audio, which, when rendered to a listener, enables the listener to experience the sound field as if they were present in the location of the microphone array. The close microphones in such embodiments are configured to capture high quality close-up audio signals (for example from a key person's voice, or a musical instrument). When mixed to the spatial audio field, the attributes of the key source such as gain, timbre and spatial position may be adjusted in order to provide the listener with a much more realistic immersive experience. In addition, it is possible to produce more point-like auditory objects, thus increasing the engagement and intelligibility.

In this example the microphone array 107 is located on a camera crane 109 which may pivot to change the location and orientation of the microphone array 107.

In the example shown in FIG. 1 the keyboard 101 (and the associated close microphone) is shown located to the left of the scene from the perspective of the reference position, the violin 105 (and the associated close microphone) is shown located to the right of the scene from the perspective of the reference position, and the drums 103 (and the associated close microphone) located to the front or centre of the scene from the perspective of the reference position.

In this example the audio signals from the close microphones may be rendered to the viewer/listener from the direction of their position. The positions of the microphone array and the close microphones as in FIG. 1 may be carefully chosen so that the resulting sound scene is pleasing to the listener. The mix provided to the viewer/listener may sound 'good' because the various sources from the close microphone audio signals are 'nicely' separated and balanced (some on the left, some on the right).

Figure 2:
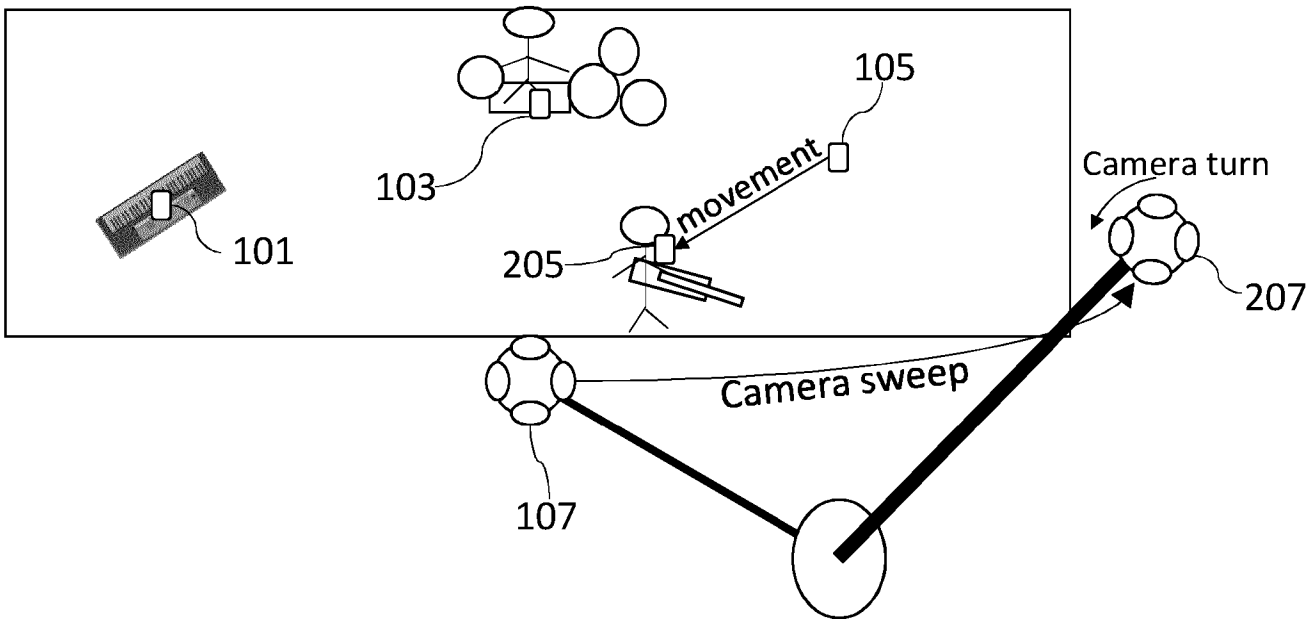
FIG. 2 shows schematically a further example capture and mixing arrangement where the close microphones and the microphone array are in a second position arrangement.

With respect to FIG. 2, the system shown in FIG. 1 may change. For example between the example shown in FIG. 1 and FIG. 2 the microphone array may change position, by pivoting on the camera crane to produce a camera sweep and rotating to produce a camera turn. The microphone array 207 at its new position and orientation thus experiences the audio scene in a different way than the microphone array 107 at its earlier position and orientation. Furthermore the close microphone, such as the violin may move from the earlier position 105 to a new position 205.

This may lead to a problematic mix being generated by the mixer. This is because all of the close microphone audio signals are now 'coming' from the same direction with respect to the microphone array. This can be shown in FIG. 3 where the separation angle 301 between all of the close microphone positions is significantly narrower than the separation angle between the close microphone positions shown in FIG. 1. This is not optimal from the audio listening experience point of view as all of the audio would in the rendered mix appear to come from directly in front of the viewer/listener.

Figure 3:
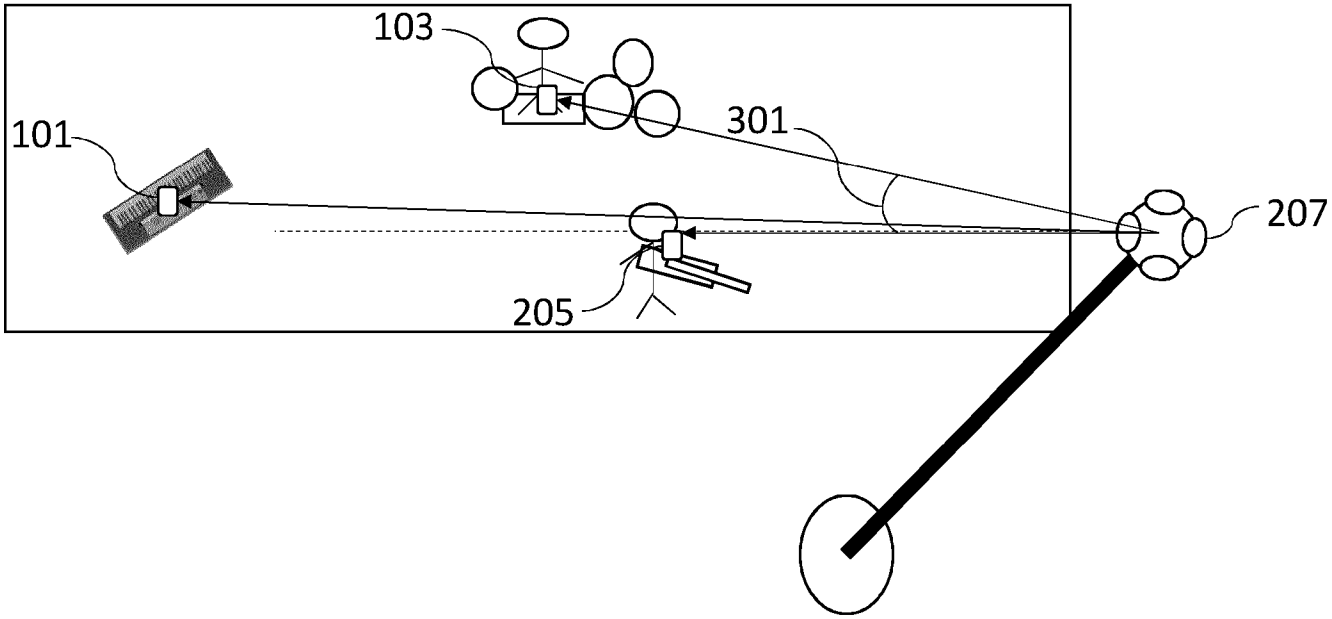
FIG. 3 shows schematically the narrow separation of sound sources produced by the close microphones and the microphone array in the second position arrangement.
Figure 4:
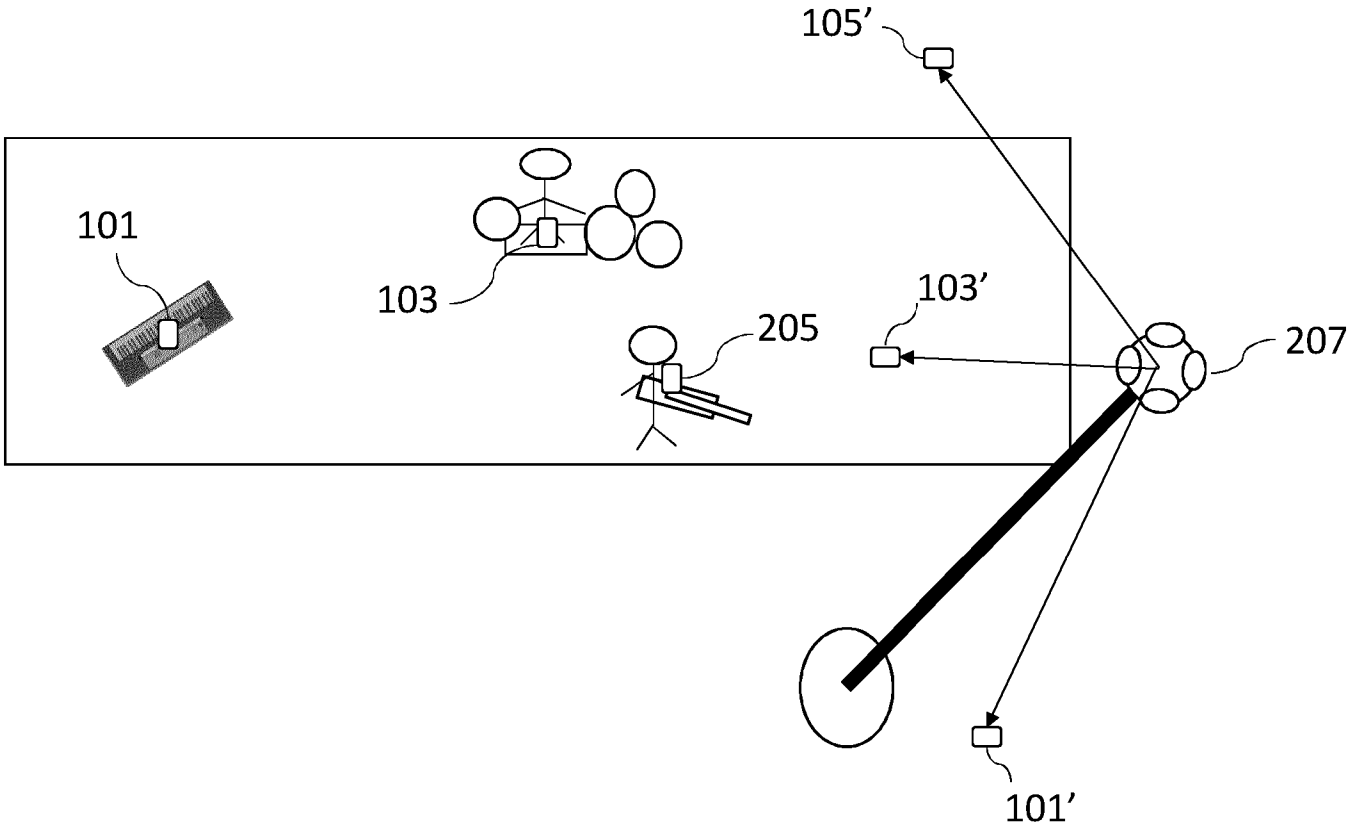
FIG. 4 shows schematically the further example capture and mixing arrangement where the close microphones and the microphone array are in a second position arrangement, but the controllable position/orientations are a mapped first position arrangement.

From a listener point of view the positions of the close microphones relative to the microphone array associated with the previous wide spaced close microphone arrangement would be preferable. However this approach is problematic. For example FIG. 4 shows an example where the close microphones are located 'physically' in the second narrow spacing arrangement with the microphone array 207 and the close microphones 101, 103 and 205 as shown in FIGS. 2 and 3. FIG. 4 also shows relative to the microphone array 207 a mapped close microphone location 101', 103' and 105' which represent the position of the keyboard close microphone 101, drum close microphone 103 and violin close microphone 105 relative to the microphone array 107 in the first position when mapped to the second position arrangement.

Although this mapped position arrangement would produce a 'better' quality wider separation mix the use of these positions may produce confusion in the viewer/listener. For example the relative positions of the violin 205 and the drum 103 seen by the viewer/listener where the violin is seen to be to the left of the drums according to the camera associated with the microphone array would not be the same as the relative positions of the mapped violin 105' and mapped drums 103' where the violin is heard as being to the right of the drums.

It would be therefore beneficial to be able to somehow control the audio source positions so that a better listening experience is achieved.

Figure 5:
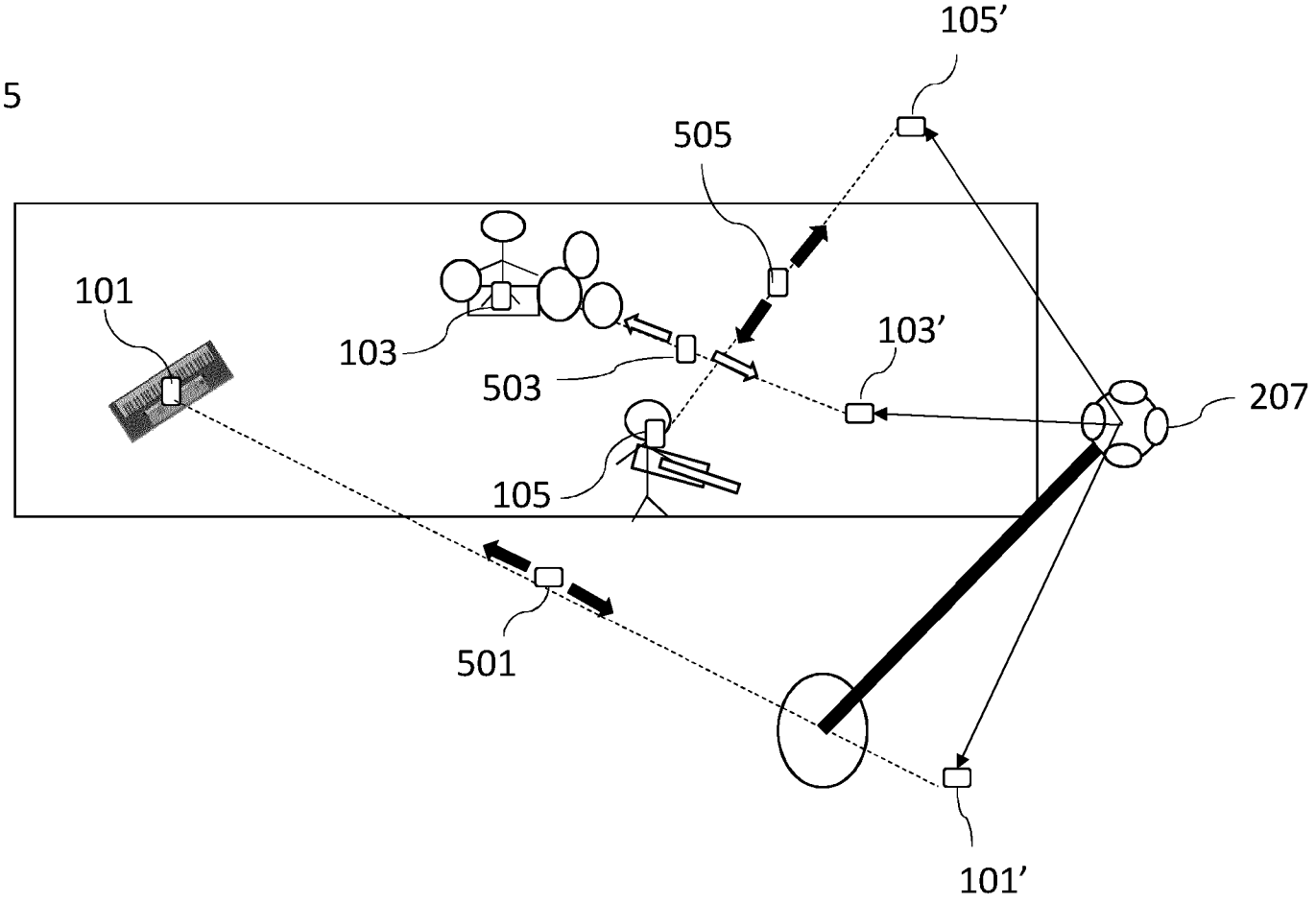
FIG. 5 shows schematically the further example capture and mixing arrangement where the close microphones and the microphone array are in a second position arrangement, but the controllable position/orientations are controlled to be between the second position and mapped first position arrangement.

The concept which is shown in embodiments such as FIG. 5 is to enable the control (either by a user to provide a manual input, or a processor to implement an automatic of semi-automatic control) of the controllable (or mix or processing) position/orientations of the close microphones relative to the microphone array between an actual position arrangement and an 'optimal' or determined good position arrangement.

Thus for example FIG. 5 shows the microphone array 207 and a controllable position/orientation for each of the close microphones which is a controlled position between the mapped position and the tracked position of the close microphones. Thus for example there is a keyboard controllable position/orientation 501 which is located on the line connecting the mapped keyboard position 101' and the actual keyboard position 101. Furthermore there is shown the drum controllable position/orientation 503 which is located on the line connecting the mapped drum position 103' and the actual drum position 103. Also there is shown a violin controllable position/orientation 505 which is located on the line connecting the mapped violin position 105' and the actual violin position 105.

In other words FIG. 5 shows that the user (or processor) may be configured to control the sound scene such that the close microphone or sound source positions may be moved between their 'actual' or correct position (based on the HAIP or other positioning) and their somehow determined 'optimal' positions (based on listening experience). That is, the user (or processor) is given control to adjust the sound scene between the 'correct' positions and nice sounding positions.

Figure 6:
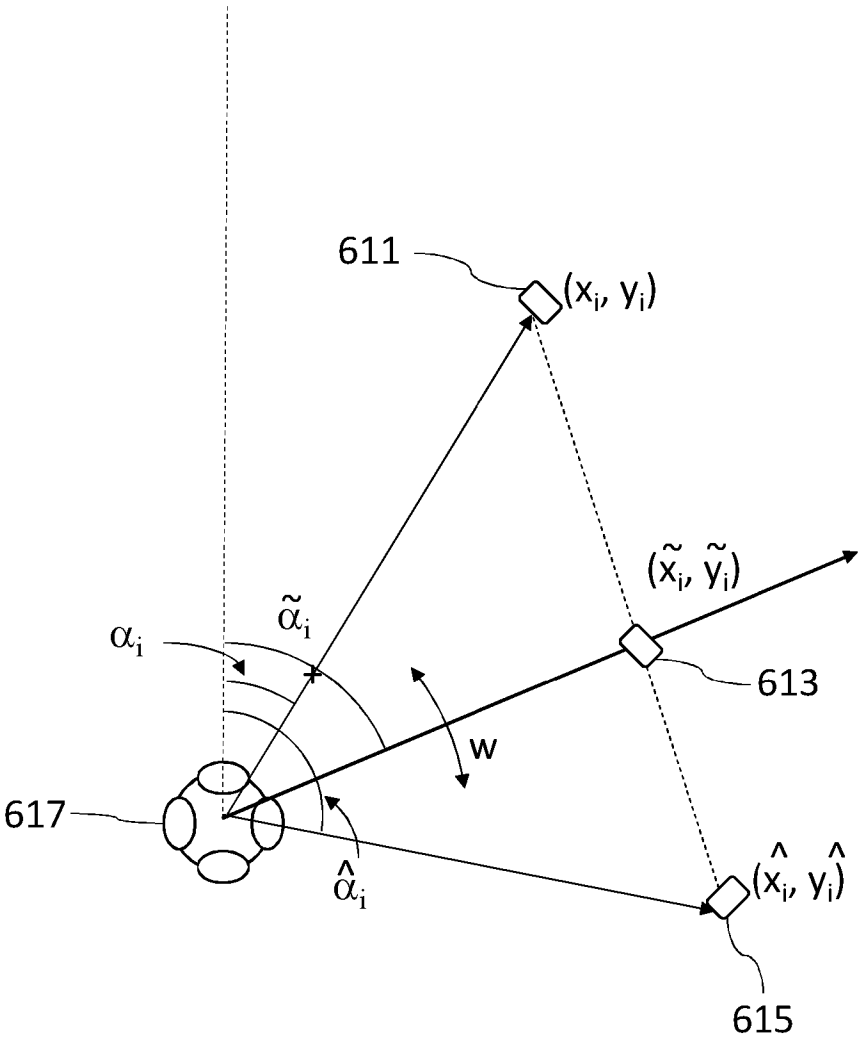
FIG. 6 shows schematically a first control parameter application to produce the controllable position/orientations according to some embodiments.
Figure 7:
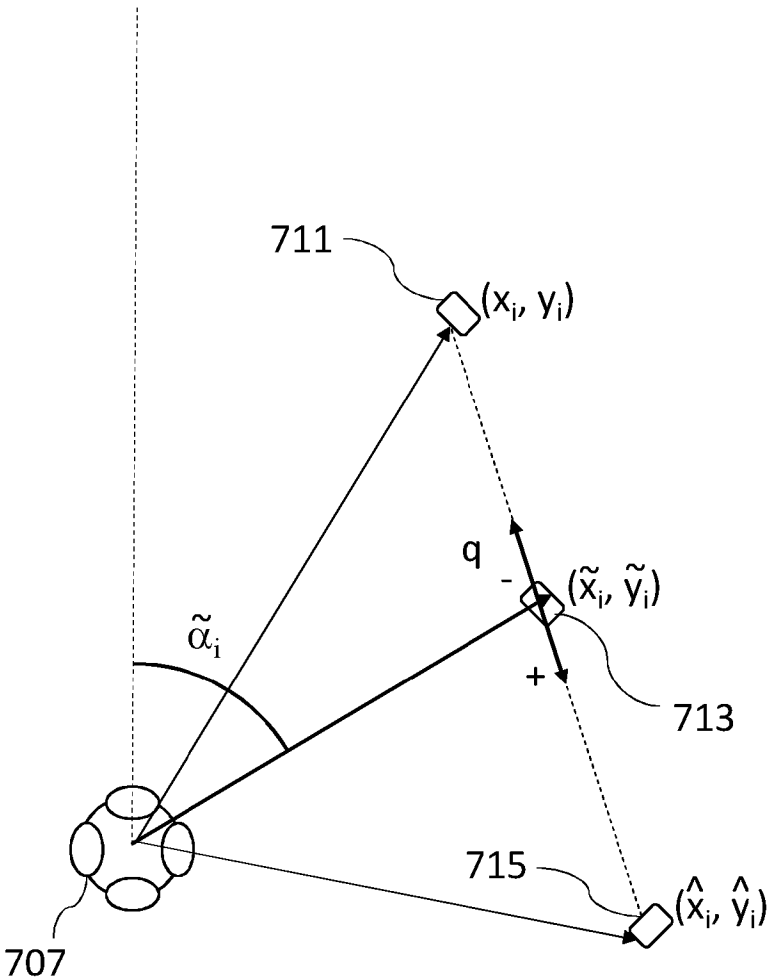
FIG. 7 shows schematically a second control parameter application to produce the controllable position/orientations according to some embodiments.

With respect to FIGS. 6 to 8 the effect of the control is implemented in embodiments are shown. For each close microphone/sound source the Figures show the effect of the control for a single close microphone. As described with respect to FIG. 5 the control implemented affects the controllable position/orientation for the close microphone where we consider three positions:

Firstly the close microphone actual, physical or correct position shown in the Figures by the location $(x_i, y_i)$, where i is the close microphone index.

A position determined to provide optimal listening experience shown in the Figures by the location, $(\hat{x}_i, \hat{y}_i)$.

A position between these positions that is controllable by the user $(\tilde{x}_i, \tilde{y}_i)$. Note that these positions are with respect to the microphone array (which in this example is the OZO camera/HAIP positioning system).

FIG. 6 for example shows an embodiment where the user (or processor) may control the controllable position/orientation $(\tilde{x}_i, \tilde{y}_i)$ 613 of the close microphone/sound source between the positions $(x_i, y_i)$ 611 and $(\hat{x}_i, \hat{y}_i)$ 615. As shown in FIG. 6 there are three angles $\alpha$, $\hat{\alpha}$ and $\alpha$. These angles are the angles between the microphone array (OZO device) front direction and the positions described above.

In some embodiments the user is provided a user interface control element in the form of a knob or slider, for example, to adjust a parameter w which adjusts the angle of the controllable position/orientation for the close microphone/ sound source. In some embodiments the control adjustment based on the value of w is provided by:

$$\tilde{\alpha}_i=\alpha_i-w(\alpha_i-\hat{\alpha}_i), w\in[0,1],\ i=1\ldots N$$

The controllable position/orientation point $(\tilde{x}_i, \tilde{y}_i)$ 613 is then determined to be the intersection between the line described by the two points $(x_i, y_i)$ 611 and $(\hat{x}_i, \hat{y}_i)$ 615 and the line crossing the origin 617 at an angle $\alpha$. In some embodiments where the distance between the controllable position/orientation and the microphone array is required and furthermore may be obtained from the new position of the close microphone relative to the microphone array then the mix position point may be modified to be located at the distance from the microphone array along the vector defined between the origin 617 and the angle $\tilde{\alpha}$.

FIG. 7 shows a further example embodiment. In the example shown in FIG. 7 an alternative way to control the position of the sound source is shown. In this example a user is provided a user interface control element in the form of a knob or slider, for example, to adjust a parameter q used to control the position between the two points $(x_i, y_i)$ 711 and $(\hat{x}_i, \hat{y}_i)$ 715. In such embodiments the user (or processor) parameter q is configured to control the position of the close microphone based on:

$$\tilde{x}_i=(1-q)x_i+q\hat{x}_i, q\in[0,1],\ i=1\ldots N$$

$$\tilde{y}_i=(1-q)y_i+q\hat{y}_i, q\in[0,1],\ i=1\ldots N$$

In some embodiments as the user (or processor) may move the close microphone/sound source position away from its correct position, it is beneficial to add some spatial extent widening to the close microphone/sound source. This widening is configured to 'soften' the effect of any mismatch in audio based (or mix) position and the video based position of the close microphone.

The control of close microphone/sound source spatial extent widening is shown in FIG. 8. In FIG. 8, it is shown that the 'width' of the close microphone/sound source is determined to be proportional to the distance of the controllable position/orientation point $(\tilde{x}_i, \tilde{y}_i)$ from the correct or physical position point $(x_i, y_i)$.

In some embodiments the 'width' of the controllable position/orientation may be set to be equal to 0.5 times the distance from the correct or physical position point.

Figure 8B:
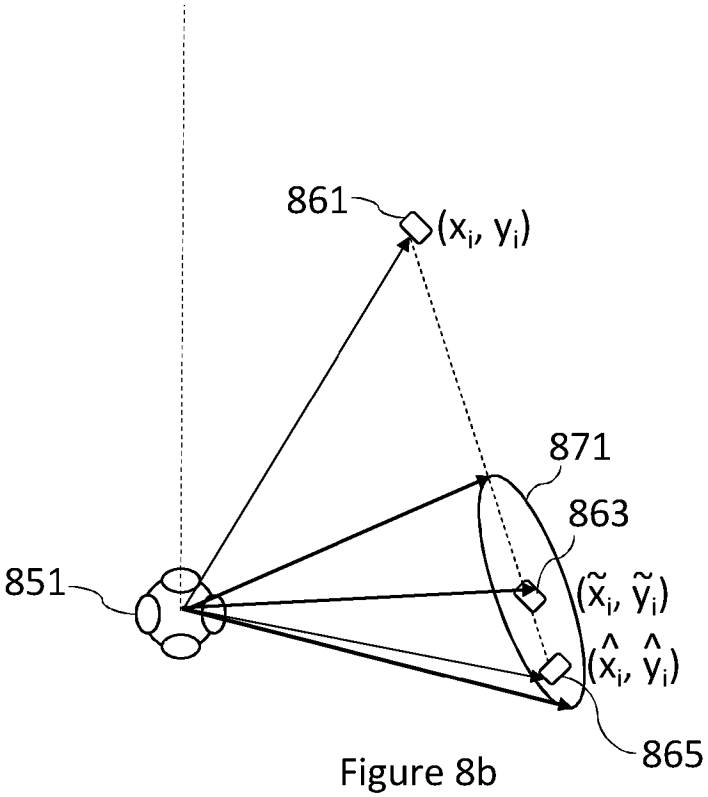
FIGS. 8*a* and 8*b* show schematically a further control parameter application to widen the spatial extent of the controllable position/orientations according to some embodiments.
Figure 8A:
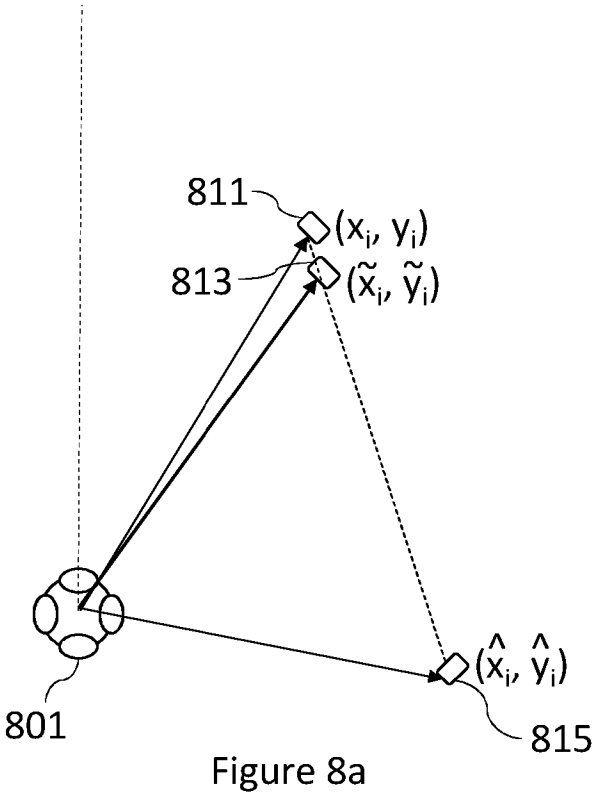

Thus for example as shown in FIG. 8*a* where the determined or controlled controllable position/orientation point $(\tilde{x}_i, \tilde{y}_i)$ 813 is close to the correct point $(x_i, y_i)$ 811 and thus away from the 'optimal' point $(\hat{x}_i, \hat{y}_i)$ 815. The spatial widening effect applied in this example results in a widening radius from the origin (microphone array 801) which is narrow and is shown in FIG. 8*a* as a single point centred at the controllable position/orientation point.

Whereas as shown in FIG. 8*b* the determined or controlled controllable position/orientation point $(\tilde{x}_i, \tilde{y}_i)$ 863 is away from the correct point $(x_i, y_i)$ 861 and thus close to the 'optimal' point $(\hat{x}_i, \hat{y}_i)$ 865. The spatial widening effect 871 applied in this example results in a widening radius from the origin (microphone array 851) which is wide and shown in FIG. 8*b* as a distribution along the line between the correct point $(x_i, y_i)$ 861 and the 'optimal' point $(\hat{x}_i, \hat{y}_i)$ 865 centred at the controllable position/orientation point.

It is noted that the examples and method described herein do not change the audio rendering functionality but may be implemented as a preprocessing module for close microphone/sound object position data. This is shown for example in FIG. 9.

Figure 9:
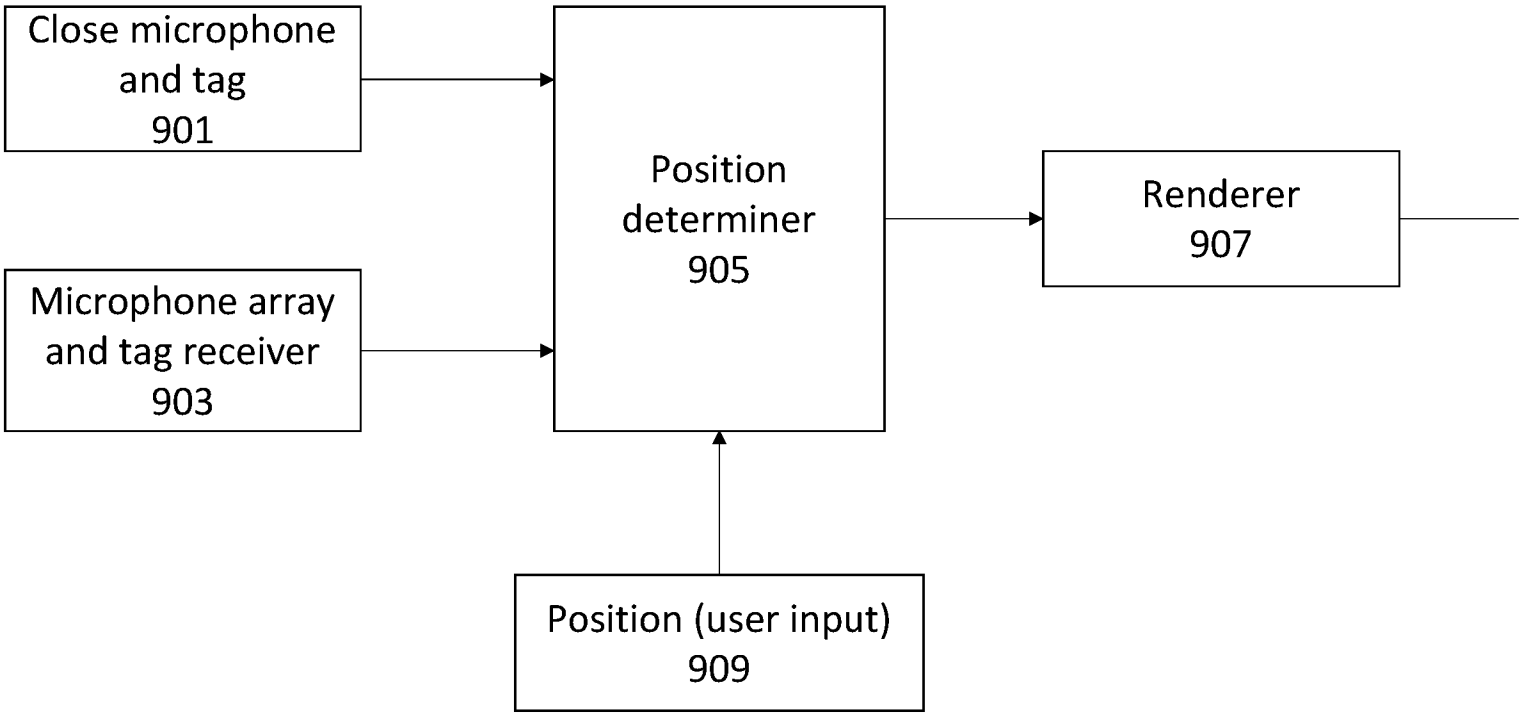
FIG. 9 shows an example mixing apparatus for controlling the position of the controllable position/orientations according to some embodiments.

FIG. 9 shows an example implementation wherein the close microphone and tag 901 transmit HAIP signals which are received by the microphone array and tag receiver 903 in order to determine the actual position of the close microphone 901 relative to the microphone array 903. The actual position may be passed to a close microphone/sound source position data updater/position determiner 905. Having received the close microphone 901 position data (the actual position the position determiner and compares these to the adjusted ideal positions.

This comparison may in some embodiments may be used to generate a suitable user interface element which is displayed to the user and enables the user to input a suitable user input 909 which in turn defines a position parameter value (such as the parameters q or w). In some embodiments a processor may derive parameter values based on the comparison between the actual position and ideal position and determine a parameter value for a controllable position/orientation according to the equations above. The updated controllable position/orientation (for the close microphone/object) data may then be provided for mixing/audio rendering to the renderer 907, which is configured to render the audio objects in the updated positions. In other words the close microphone microphone/sound source position data is updated before it is input to the audio renderer.

The renderer 907 in some embodiments may be configured to use vector-base amplitude panning techniques when loudspeaker domain output is desired (e.g. 5.1 channel output) or use head-related transfer-function filtering if binaural output for headphone listening is desired.

Figure 10:
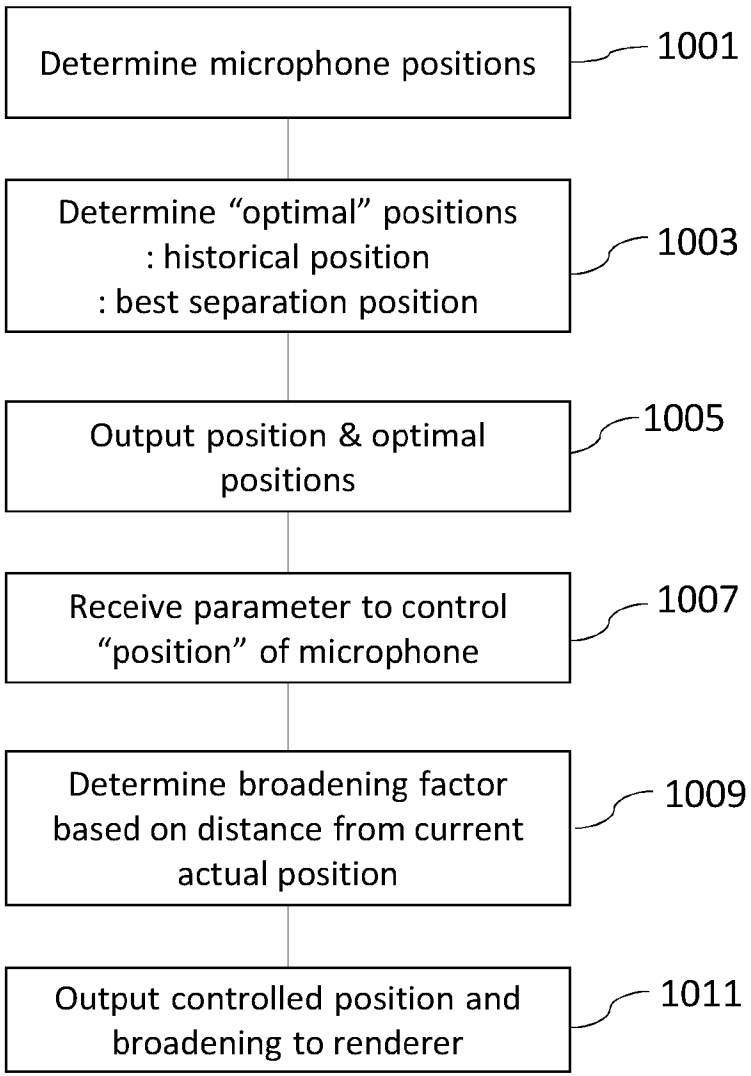
FIG. 10 shows an example flow diagram for controlling the position of the controllable position/orientations according to some embodiments.

With respect to FIG. 10 an example flow diagram of the operation of the system as shown in FIG. 9 is shown in further detail.

In some embodiments the position tracker, which may be implemented within the microphone array as part of a HAIP system or other suitable system, is configured to determine the actual positions of the close microphones/sound sources relative to the microphone array.

The operation of determining the microphone positions is shown in FIG. 10 by step 1001.

The position determiner may receive the close microphone position data (the actual positions) and furthermore determine ideal or optimised positions. These ideal or optimised positions may expert user determined, by a historical liked positioning, or determined using any other suitable 'optimisation' of the positions. For example in some embodiments the selected positions may be selected by the person responsible for the mixing of the sources. In such embodiments the person responsible for the mixing defines the positions by selecting the positions for each source separately. In some embodiments the person responsible for the mixing defines the positions guiding the performers and camera to a 'default position' and setting this as the position. FIG. 1 for example may be an example of the camera and performer positions being at the 'default position' and the person responsible for the mixing indicates to the system that these are the chosen 'optimal' positions. These ideal positions may then be mapped to the current position of the microphone array to produce mapped ideal positions.

The operation of determining the ideal microphone positions/mapped ideal positions is shown in FIG. 10 by step 1003.

The position determiner may furthermore receive a control parameter to control the position of the microphones.

The receiving of the control parameter is shown in FIG. 10 by step 1007.

The position determiner may then compare the actual positions to the mapped ideal positions and based on the control parameter determine a controllable position/orientation between the two. Furthermore in some embodiments the position determiner may apply a spatial widening to the position based on the difference between the controllable position/orientation and the actual position.

The operation of determining the controllable position/orientation based on the actual position and the mapped ideal position and the control input (and optionally the spatial widening) is shown in FIG. 10 by step 1009.

The position determiner may then output the (spatially widened) controllable position/orientation to the renderer, which may be configured to render/process an output audio signal based on the determined controllable position/orientation.

The operation of outputting the controllable position/orientation to the renderer is shown in FIG. 10 by step 1011.

Figure 11:
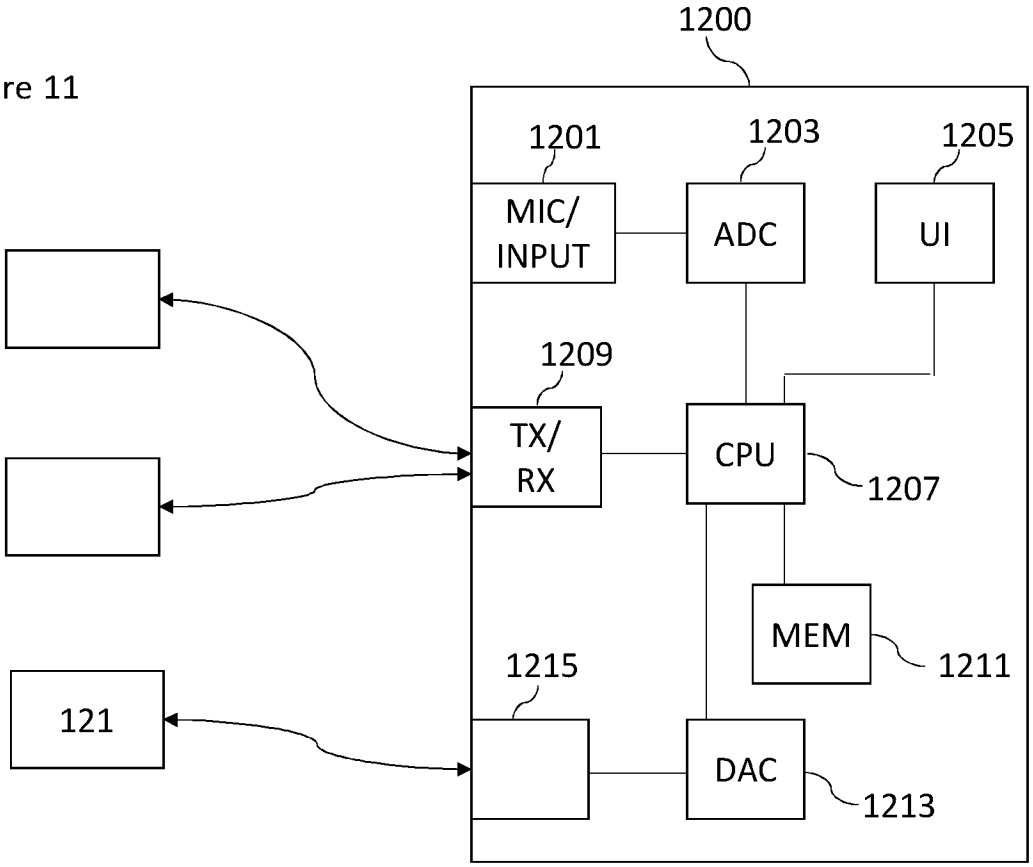
FIG. 11 shows schematically an example device suitable for implementing the capture and/or render apparatus shown in FIG. 9.

With respect to FIG. 11 an example electronic device which may be used as the microphone array capture device and/or the position determiner is shown. The device may be any suitable electronics device or apparatus. For example in some embodiments the device 1200 is a mobile device, user equipment, tablet computer, computer, audio playback apparatus, etc.

The device 1200 may comprise a microphone array 1201. The microphone array 1201 may comprise a plurality (for example a number N) of microphones. However it is understood that there may be any suitable configuration of microphones and any suitable number of microphones. In some embodiments the microphone array 1201 is separate from the apparatus and the audio signals transmitted to the apparatus by a wired or wireless coupling. The microphone array 1201 may in some embodiments be the microphone array as shown in the previous Figures.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, microphone position control, position determination and tracking and other code routines such as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200. In some embodiments the user interface 1205 may be the user interface for communicating with the position determiner as described herein.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

For example as shown in FIG. 11 the transceiver 1209 may be configured to communicate with the renderer as described herein.

The transceiver 1209 can communicate with further apparatus by any suitable known communications protocol. For example in some embodiments the transceiver 1209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as at least part of the renderer. As such the transceiver 1209 may be configured to receive the audio signals and positional information from the microphone array/close microphones/position determiner as described herein, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Furthermore the device 1200 can comprise in some embodiments an audio subsystem output 1215. An example as shown in FIG. 11 shows the audio subsystem output 1215 as an output socket configured to enabling a coupling with headphones 121. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture, audio processing and audio rendering components, it would be understood that in some embodiments the device 1200 can comprise just some of the elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one processor; and at least one non-transitory memory including computer program code, the at least one memory and the computer program code configured to, with the at least one processor, cause the apparatus at least to:

receive a physical position/orientation of at least one audio source relative to a capture device, wherein an audio scene comprises the at least one audio source and the capture device, wherein the capture device comprises a microphone array for capturing audio signals of the audio scene, and wherein the capture device comprises a capture position/orientation;

determine an updated physical position/orientation of the at least one audio source relative to the capture position/orientation, wherein the determining of the updated physical position/orientation is based on a change in at least one of:

the physical position/orientation of the at least one audio source, or the capture position/orientation of the capture device;

provide at least one control parameter; and adjust the physical position/orientation of the at least one audio source relative to the capture position/orientation using the at least one control parameter in order to at least partially eliminate a perceptual effect which the updated physical position/orientation of the at least one audio source relative to the capture position/orientation would cause during rendering of the at least one audio source.

2. The apparatus as claimed in claim 1, wherein the capture device further comprises at least one camera for capturing images of the audio scene, wherein the at least one camera is positioned relative to the capture orientation.

3. The apparatus as claimed in claim 2, wherein the updated physical position/orientation is captured on a first image of the at least one camera and the physical position/orientation is captured on a second image of the at least one camera.

4. The apparatus as claimed in claim 3, wherein the adjusting of the physical position/orientation of the at least one audio source relative to the capture position/orientation comprises selecting, as the adjusted position/orientation, the physical position/orientation of the at least one audio source relative to the capture position/orientation, such that a visually observed position/orientation of the at least one audio source differs from an audio experienced position/orientation of the at least one audio source.

5. The apparatus as claimed in claim 1, wherein the at least one memory and the computer program code are further configured to, with the at least one processor, cause the apparatus to:

pass the adjusted position/orientation of the at least one audio source to a renderer to control a mixing or rendering of an audio signal associated with the at least one audio source based on the adjusted position/orientation.

6. The apparatus as claimed in claim 1, wherein the at least one control parameter comprises a weighting parameter, and wherein the at least one memory and the computer program code are configured to, with the at least one processor, cause the apparatus to:

determine the adjusted orientation based on one of the physical orientation of the at least one audio source relative to the capture orientation or the updated physical orientation of the at least one audio source relative to the capture orientation, which is combined with the weighting parameter applied to an orientation difference between the physical orientation of the at least one audio source relative to the capture orientation and the updated physical orientation of the at least one audio source relative to the capture orientation; and determine the adjusted position based on an intersection between a first line between the physical position of the at least one audio source relative to the capture orientation and the updated physical position of the at least one audio source relative to the capture orientation and a second line from the capture device at the adjusted orientation.

7. The apparatus as claimed in claim 1, wherein the at least one control parameter comprises a weighting parameter, and wherein the at least one memory and the computer program code are configured to, with the at least one processor, cause the apparatus to:

determine the adjusted orientation based on one of the physical orientation of the at least one audio source relative to the capture orientation or the updated physical orientation of the at least one audio source relative to the capture orientation, which is combined with the weighting parameter applied to an orientation difference between the physical orientation of the at least one audio source relative to the capture orientation and the updated physical orientation of the at least one audio source relative to the capture orientation, and determine the adjusted position based on an arc with an origin at the capture device and defined with the physical position of the at least one audio source relative to the capture orientation and the updated physical position of the at least one audio source relative to the capture orientation and a line from the capture device at the adjusted orientation.

8. The apparatus as claimed in claim 1, wherein the adjusting of the physical position/orientation of the at least one audio source further comprises adjusting a width of the adjusted position/orientation, the width of the adjusted position/orientation being based on the distance from the adjusted position/orientation to the updated physical position/orientation of at least one audio source relative to the capture orientation.

9. The apparatus as claimed in claim 8, wherein the at least one memory and the computer program code are configured to, with the at least one processor, cause the apparatus to:

set the width of the adjusted position/orientation as one half a normalised distance from the controllable position/orientation to the updated physical position/orientation of the at least one audio source relative to the capture orientation.

10. A method comprising:

receiving a physical position/orientation of at least one audio source relative to a capture device, wherein an audio scene comprises the at least one audio source and the capture device, wherein the capture device comprises a microphone array for capturing audio signals of the audio scene, and wherein the capture device comprises a capture position/orientation;

determining an updated physical position/orientation of the at least one audio source relative to the capture position/orientation, wherein the determining of the updated physical position/orientation is based on a change in at least one of:

the physical position/orientation of the at least one audio source, or the capture position/orientation of the capture device;

providing at least one control parameter; and adjusting the physical position/orientation of the at least one audio source relative to the capture position/orientation using the at least one control parameter in order to at least partially eliminate a perceptual effect which the updated physical position/orientation of the at least one audio source relative to the capture position/orientation would cause during rendering of the at least one audio source.

11. The method as claimed in claim 10, wherein the capture device further comprises at least one camera for capturing images of the audio scene, wherein the at least one camera is positioned relative to the capture orientation.

12. The method as claimed in claim 11, wherein the updated physical position/orientation is captured on a first image of the at least one camera and the physical position/orientation is captured on a second image of the at least one camera.

13. The method as claimed in claim 12, wherein the adjusting of the physical position/orientation of the at least one audio source relative to the capture position/orientation comprises selecting, as the adjusted position/orientation, the physical position/orientation of the at least one audio source relative to the capture position/orientation, such that a visually observed position/orientation of the at least one audio source differs from an audio experienced position/orientation of the at least one audio source.

14. The method as claimed in claim 10, further comprising passing the adjusted position/orientation of the at least one audio source to a renderer to control a mixing or rendering of an audio signal associated with the at least one audio source based on the adjusted position/orientation.

15. The method as claimed in claim 10, wherein receiving at least one control parameter comprises receiving a weighting parameter, and controlling the controllable position/orientation further comprises:

determining the adjusted orientation based on one of the physical orientation of the at least one audio source relative to the capture orientation or the updated physical orientation of the at least one audio source relative to the capture orientation, which is combined with the weighting parameter applied to an orientation difference between the physical orientation of the at least one audio source relative to the capture orientation and the updated physical orientation of the at least one audio source relative to the capture orientation, and determining the adjusted position based on an intersection between a first line between the physical position of the at least one audio source relative to the capture orientation and the updated physical position of the at least one audio source relative to the capture orientation and a second line from the capture device at the adjusted orientation.

16. The method as claimed in claim 10, wherein receiving the at least one control parameter comprises receiving a weighting parameter, and controlling the controllable position/orientation further comprises:

determining the adjusted orientation based on one of the physical orientation of the at least one audio source relative to the capture orientation or the updated physical orientation of the at least one audio source relative to the capture orientation, which is combined with the weighting parameter applied to an orientation difference between the physical orientation of the at least one audio source relative to the capture orientation and the updated physical orientation of the at least one audio source relative to the capture orientation, and determining the adjusted position based on an arc with an origin at the capture device and defined with the physical position of the at least one audio source relative to the capture orientation and the updated physical position of the at least one audio source relative to the capture orientation and a line from the capture device at the adjusted orientation.

17. The method as claimed in claim 10, wherein the adjusting of the physical position/orientation of the at least one audio source further comprises adjusting a width of the adjusted position/orientation, the width of the adjusted position/orientation being based on the distance from the adjusted position/orientation to the updated physical position/orientation of at least one audio source relative to the capture orientation.

18. The method as claimed in claim 17, wherein adjusting the width of the adjusted position/orientation comprises setting the width of the adjusted position/orientation as one half a normalised distance from the adjusted position/orientation to the updated physical position/orientation of the at least one audio source relative to the capture orientation.

19. The apparatus as claimed in claim 1, further configured to generate a user interface element to control at least one of the physical position/orientation or the updated physical position/orientation of the at least one audio source.

20. The method as claimed in claim 10, further comprising generating a user interface element for controlling at least one of the physical position/orientation or the updated physical position/orientation of the at least one audio source.

21. The apparatus as claimed in claim 1, wherein the adjusted position/orientation of the at least one audio source comprises a position between the received physical position/orientation of the at least one audio source and the updated physical position/orientation of the at least one audio source.

* * * * *